US007306290B2

(12) United States Patent
Wiecek

(10) Patent No.: US 7,306,290 B2
(45) Date of Patent: Dec. 11, 2007

(54) KNOCKDOWN ATTACHMENT MECHANISM FOR A RECLINING CHAIR

(75) Inventor: Glenn N. Wiecek, Shelbyville, KY (US)

(73) Assignee: L & G Property Management Company, South Gate, CA (US)

( * ) Notice: Subject to any disclaimer, the term of this patent is extended or adjusted under 35 U.S.C. 154(b) by 75 days.

(21) Appl. No.: 11/290,401

(22) Filed: Nov. 30, 2005

(65) Prior Publication Data

US 2007/0120410 A1 May 31, 2007

(51) Int. Cl.
*A47C 7/42* (2006.01)

(52) U.S. Cl. ..... 297/440.15; 297/440.16; 297/440.2

(58) Field of Classification Search ..... 297/440.2, 297/440.21, 440.15, 440.16; 403/330, 374.5
See application file for complete search history.

(56) References Cited

U.S. PATENT DOCUMENTS

| | | | | |
|---|---|---|---|---|
| 3,525,549 | A * | 8/1970 | Knabusch et al. | 297/440.21 |
| 4,890,888 | A * | 1/1990 | Kostin | 297/440.21 |
| 5,135,284 | A * | 8/1992 | Crum | 297/440.15 |
| 5,184,871 | A * | 2/1993 | LaPointe et al. | 297/440.21 |
| 5,269,589 | A * | 12/1993 | Brothers et al. | 297/440.16 |
| 6,557,942 | B1 | 5/2003 | Shieh | |
| 6,698,840 | B1 * | 3/2004 | Tseng | 297/440.15 |
| 6,752,464 | B1 * | 6/2004 | Tseng | 297/440.16 |

* cited by examiner

*Primary Examiner*—Peter R. Brown
(74) *Attorney, Agent, or Firm*—Shook, Hardy & Bacon, L.L.P.

(57) ABSTRACT

A chair is disclosed having a mechanism for assembling and disassembling a seatback thereto. The mechanism, which is fixed to the base of the chair, comprises a coupling plate having slots for receiving bolts from the seatback seat posts. Rotatably coupled to the coupling plate is a locking plate that when rotated about a fastener, secures a bolt from the seat post into slots in the locking plate and coupling plate, thereby securing the seatback to the base of the chair.

11 Claims, 3 Drawing Sheets

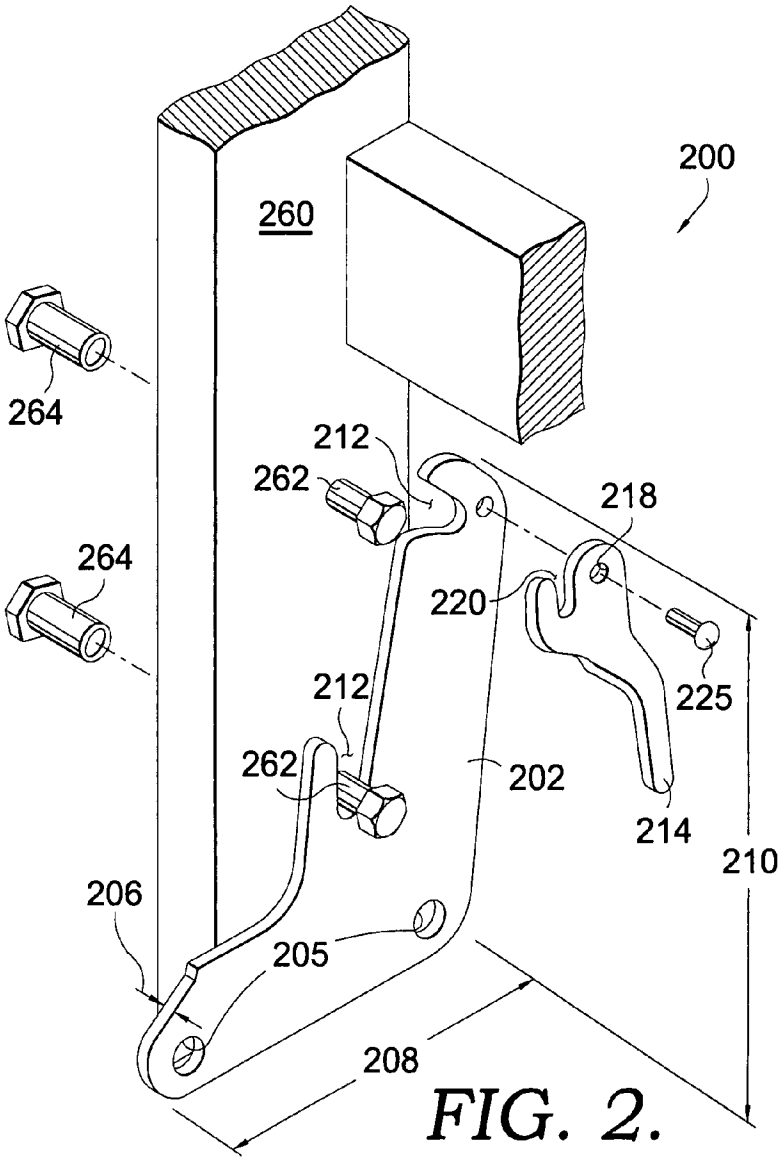
FIG. 2.
FIG. 1.
(PRIOR ART)
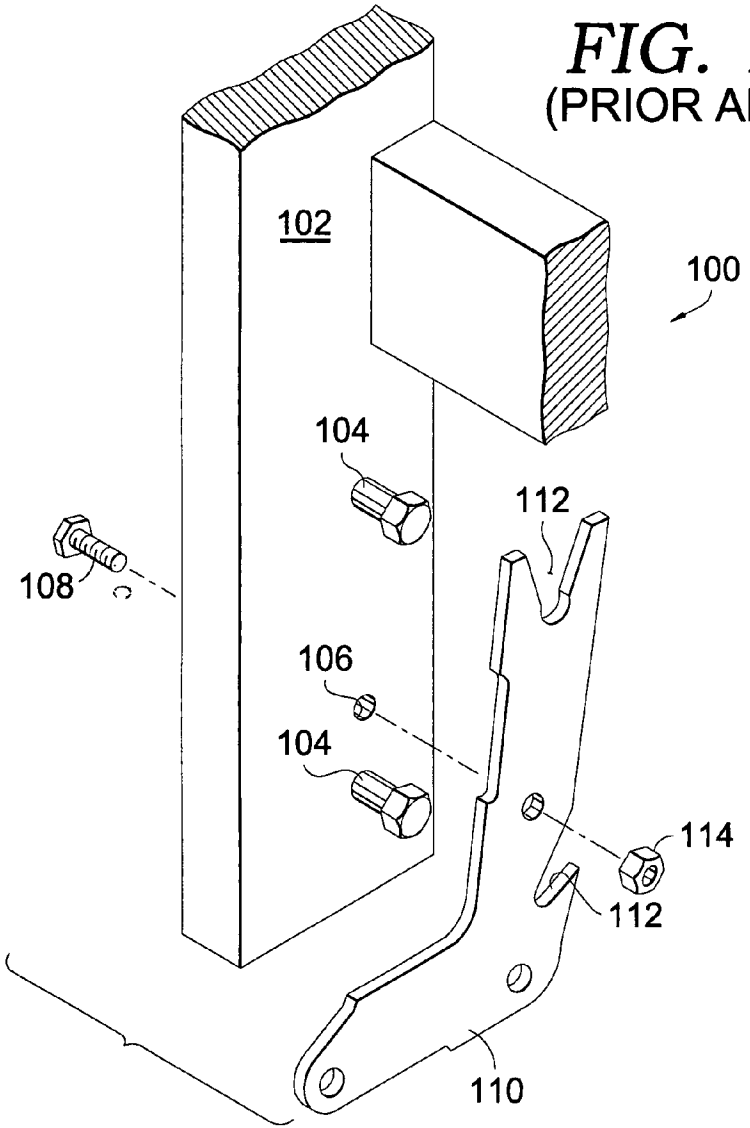

KNOCKDOWN ATTACHMENT MECHANISM FOR A RECLINING CHAIR

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to the furniture industry. More particularly, the present invention discloses a mechanism and apparatus for securing a backrest onto a chair.

BACKGROUND OF THE INVENTION

In the furniture industry, designers and manufacturers must settle on a design that is appealing to the consumer in terms of visual appearance, comfort, and price, yet is manufacturer-friendly. As economic conditions change, more furniture manufacturers are sending their work to areas overseas that have lower labor costs in order to maximize profits, even though that requires shipping their products back to the United States. One aspect of the manufacturing process in which cost savings can be obtained is through more cost-effective packaging and shipping. For example, these costs can be controlled by shipping furniture from the manufacturer in a semi-finished condition, such that parts of the furniture have been removed or disassembled for shipment. This allows a smaller or more compact shipping container to be used, thereby reducing wasted space. Not only is this semi-finished condition advantageous for shipping from the manufacturer's perspective, but it can be advantageous for consumers as well. For those consumers who do not take advantage of store delivery, having smaller and more compact containers allows for easier transportation of the product from the retail store.

With respect to chairs, and reclining chairs in particular, this semi-finished condition usually includes the chair backrest having been removed from the seat for shipment, so as to reduce the crate/carton size. However, since the manufacturing often occurs at a location other than that of final assembly, it is necessary to inspect the chairs as they come off of the assembly line prior to packaging and shipment, and later, final assembly. In other words, the chair backrest is typically installed on the chair frame to ensure the backrest and frame fit properly together. The backrest is then removed for shipping. Prior inspection assembly mechanisms were often difficult to use and time consuming, requiring bolting one part to another or snapping interlocking spring clip pieces together, then loosening the bolts or unsnapping the interlocked parts. An example of such a device is shown in FIG. 1. A bolted assembly mechanism 100 is shown including a portion of a back post 102. Back post 102 includes two bolts 104 and a through hole 106 for receiving locking bolt 108. Fixed to a base (not shown) is bracket 110. It is through bracket 110 that back post 102, and hence a backrest (not shown), is fixed to the base and the associated seat. To trial-fit the backrest to the base, back post 102 is positioned such that bolts 104 slide into slots 112 of bracket 110. Next, locking bolt 108 is placed through hole 106 in back post 102 and through a hole in bracket 110 where it is held in place by nut 114. Typically a backrest comprises two back posts 102 as part of the backrest framing. Therefore, this assembly process is then repeated for the other back post 102 and corresponding bracket 110. To disassemble the backrest from the base, the steps of the assembly process are reversed, such that nut 114 is loosened from each locking bolt 108, and the locking bolts 108 are removed from bracket 110 and back post 102. Finally, back post 102 is separated from the base by sliding back posts 102 in a direction such that bolts 104 disengage from slots 112 of bracket 110.

This assembly mechanism of the prior art is one of many that require a lengthy period of time assembling and disassembling. The method and apparatus described above also include the use of loose pieces (locking bolt 108 and nut 114) that can be lost or misplaced during the trial assembly and disassembly process. Therefore, it is desired to provide a mechanism providing quick and easy assembling and disassembling of the chair backrests to the base and seat without loose components.

SUMMARY OF THE INVENTION

The present invention generally relates to a chair assembly having a mechanism for coupling a seat back to a base. The mechanism has a coupling plate, a locking plate, and a fastener for rotatably coupling the locking plate to the coupling plate. The mechanism is designed such that bolts extending from seat back posts slide into first slots in the coupling plate and the locking plate rotates about the fastener in a manner such that a slot in the locking plate coincides with a portion of the slot in the coupling plate to form a locking region. A bolt positioned in one of the first slots is contained within this locking region.

The present invention provides a quick and easy approach of assembling and disassembling a backrest to/from a seat base. Once the bolts of the back posts are located in the slots, a simple turn of the locking plate encloses the opening in the slot of the coupling plate with a portion of the locking plate such that the bolt is engaged in the locking region. No loose parts, such as nuts and bolts, or other tools are required to lock the backrest to a base.

BRIEF DESCRIPTION OF THE SEVERAL VIEWS OF THE DRAWINGS

The present invention is described in detail below with reference to the attached drawing figures, wherein:

FIG. 1 is a perspective view of a portion of a seatback assembly mechanism of the prior art;

FIG. 2 is a perspective, exploded, view of a portion of a seatback assembly mechanism in accordance with an embodiment of the present invention;

DETAILED DESCRIPTION OF THE INVENTION

Figure 4:
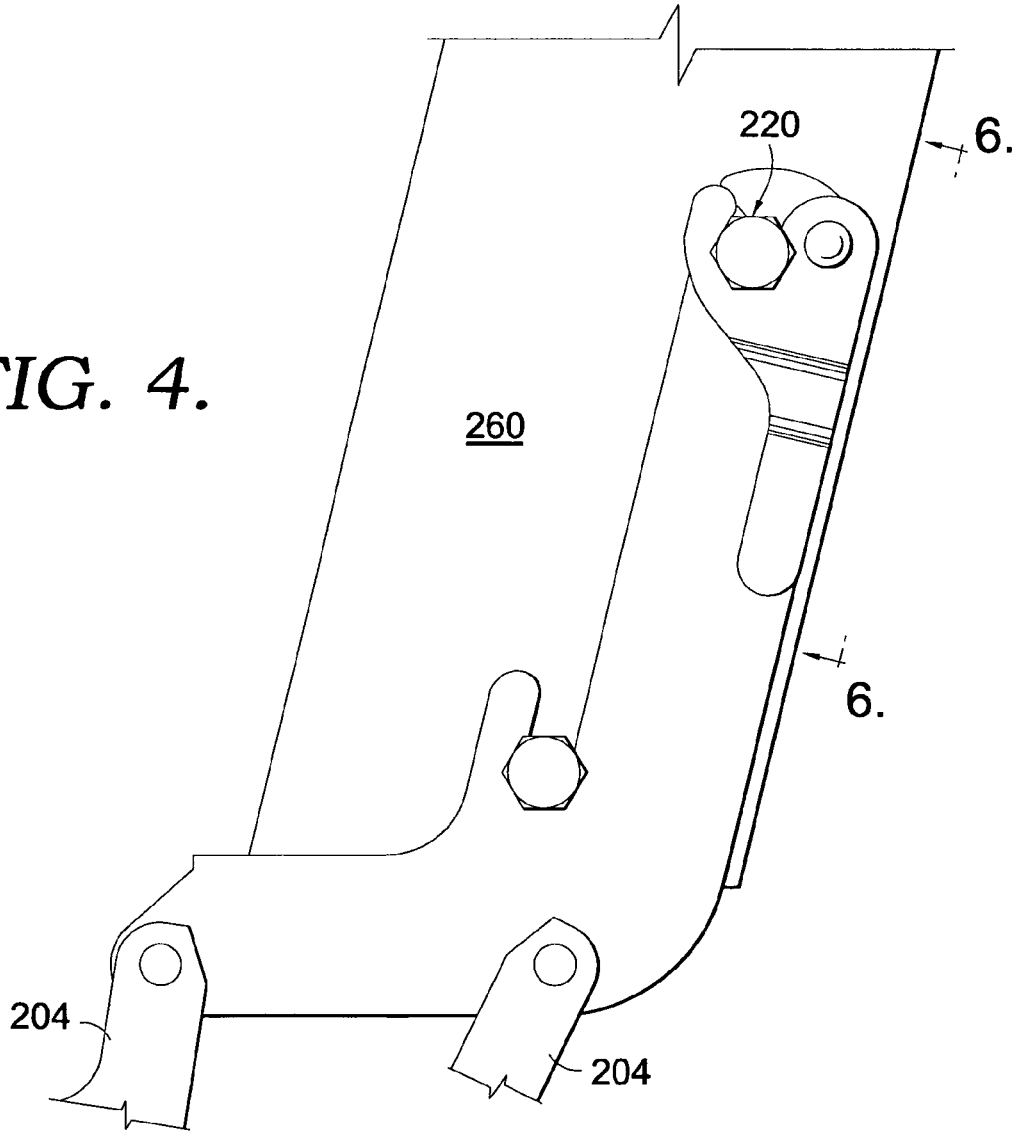
FIG. 4 is an side elevation view of a portion of a seatback assembly mechanism showing the seatback installed onto a base in accordance with an embodiment of the present invention.
Figure 5:
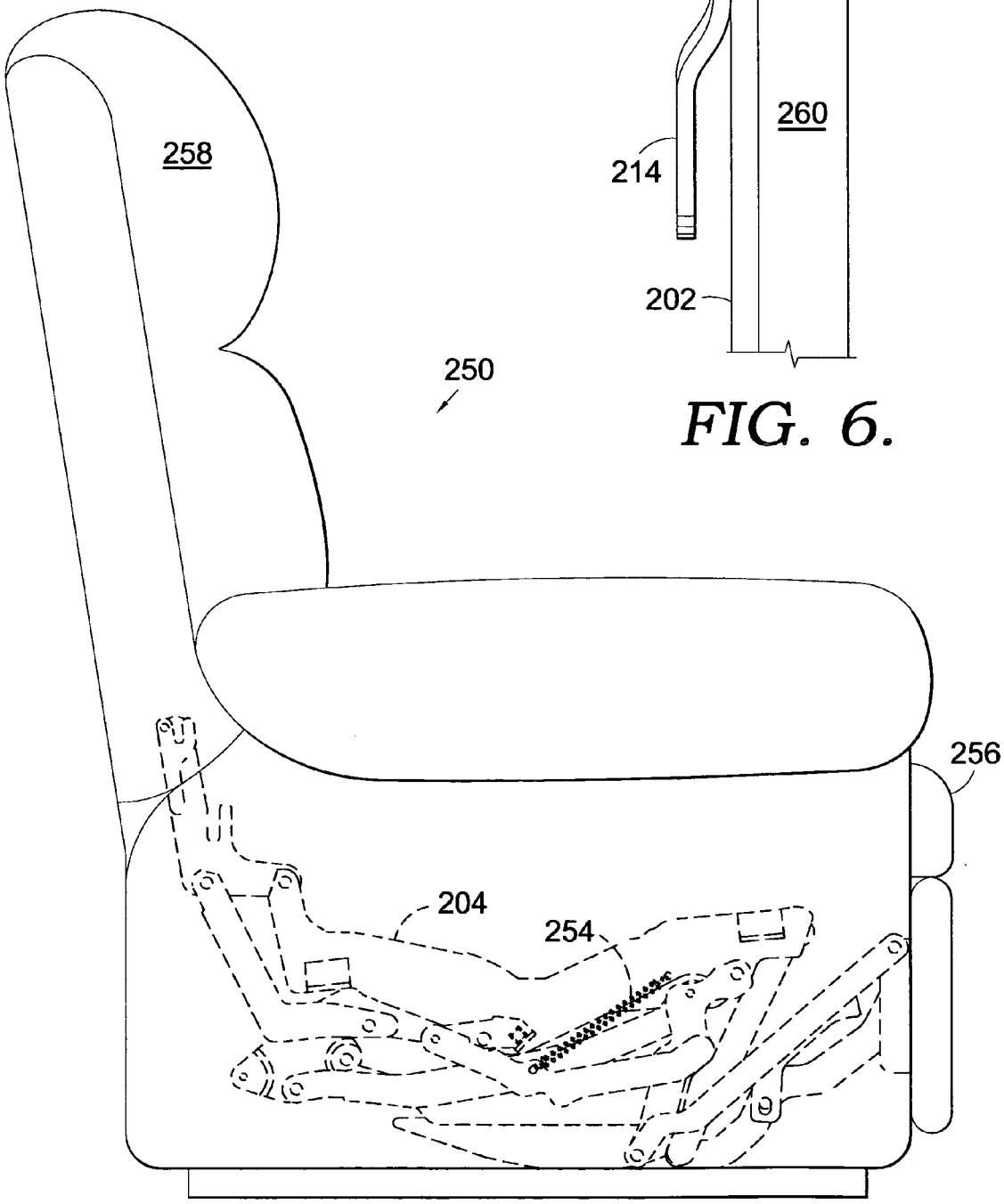
FIG. 5 is a side elevation view of a reclining chair incorporating an embodiment of the present invention.

The present invention will now be described in greater detail with specific reference to FIGS. 2-6. Referring now to FIG. 2, a mechanism 200 for coupling a seat back to a base mechanism is shown. Mechanism 200 includes a coupling plate 202 connected to a base 204 (FIG. 5). The coupling plate 202 has a first thickness 206, a first length 208, a first height 210, and a plurality of first slots 212 formed in first thickness 206. In the embodiment shown, there are two slots 212. Coupling plate 202 is connected to base mechanism 204 at base holes 205, as best seen in FIGS. 4 and 5.

Figure 3:
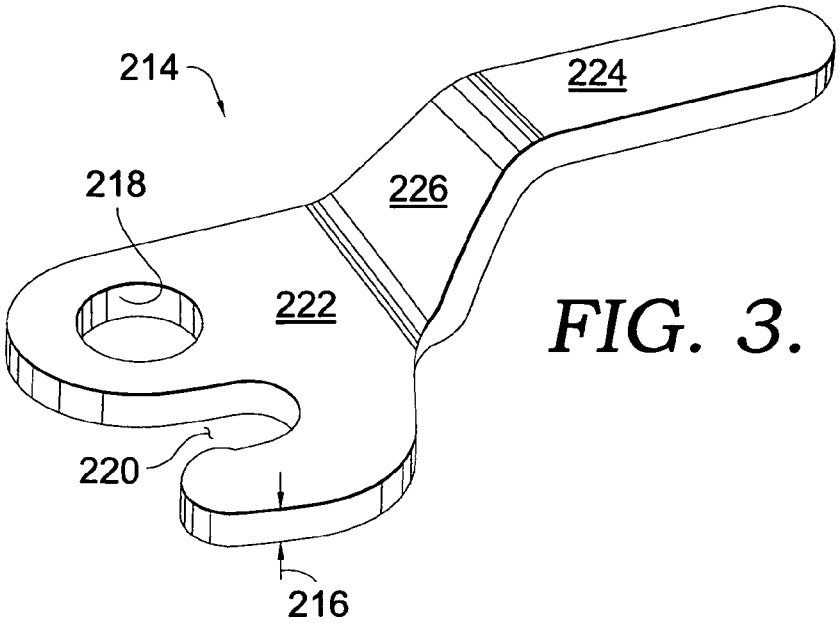
FIG. 3 is a perspective view of the locking plate in accordance with an embodiment of the present invention.

With reference now to FIGS. 2 and 3, mechanism 200 further comprises a locking plate 214 that has a second thickness 216, hole 218, and a second slot 220 formed therein. Locking plate 214 generally includes a first portion 222, a second portion 224 that is generally parallel to first portion 222, and a connecting section 226 that is oriented at an angle relative to first portion 222 to connect first portion 222 to second portion 224. As it can be seen in FIGS. 2 and 3, second slot 220 and hole 218 in locking plate 214 are located in first portion 222. Given the angular orientation of connecting section 226, second portion 224 is offset from first portion 222 and serves as a handle for plate 214, as further described below.

Rotatably coupling locking plate 214 to coupling plate 202 is a fastener 225, which is preferably a rivet. By fastening locking plate 214 to coupling plate 202 with fastener 225, locking plate 214 can rotate relative to coupling plate 202. When locking plate 214 rotates about fastener 225, a portion of second slot 220 coincides with a portion of one of first slots 212 to form a locking region, as shown in FIG. 4. It is in this locking region that a bolt from a seatback will be located, and locked in place, such that the seatback is fixed to the base, as is described in more detail below.

Having disclosed the general features of the seat back assembly/disassembly mechanism, the invention will be better understood with respect to its preferred operating environment, in this case, a reclining chair. Referring now to FIG. 5, a reclining chair assembly 250 comprises a base 204 having a reclining mechanism 254, a seat 256 mounted to base 204, and a backrest 258 having a frame and a plurality of back posts 260 (see FIGS. 2 and 4). Referring back to FIG. 2, back posts 260 include a plurality of bolts 262 extending a distance D (see FIG. 6) therefrom. Bolts 262 are fixed to back posts 260 by way of nuts 264 thereby establishing distance D. Bolts 262 are positioned on back posts 260 so that they coincide with slots 212 on plate 202.

Fixed to base 204 is mechanism 200 for securing backrest 258 to base 204. Mechanism 200 is attached to base 204 by way of base holes 205 in coupling plate 202. Plate 202 is thus one member of base mechanism 204. As previously discussed, mechanism 200 is used to quickly and easily assemble or disassemble a backrest to a base. Bolts 262 of back post 260 engage first slots 212 in coupling plate 202, after which locking plate 214 rotates about fastener 225 to engage a bolt 262 in the locking region, as shown in FIG. 4, thereby securing backrest 258 to base 204.

Figure 6:
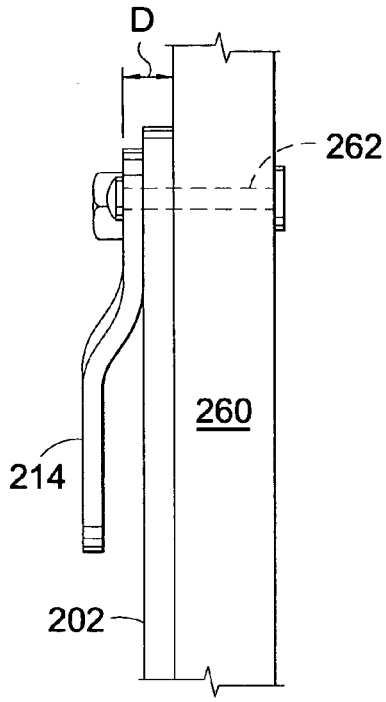
FIG. 6 is an aft elevation view of a portion of a seatback assembly mechanism taken along line 6-6 of FIG. 4 in accordance with an embodiment of the present invention.

Referring to FIG. 6, an aft elevation view of a portion of a seatback assembly mechanism is shown. In this view, a better definition of distance D is provided. More specifically, distance D is equal to the sum of first thickness 206, second thickness 216, and an assembly tolerance. The assembly tolerance will vary depending on the manufacturer, but some tolerance must be allowed for material and machining variations. The distance D that bolt 262 extends from back post 260 allows for sufficient distance such that when in the "locked" position, both slot 212 of coupling plate 214 and slot 220 in first portion 222 of locking plate 214 are between back post 260 and head of bolt 262, within distance D.

As briefly described above, the present invention provides a means for quickly, and easily, assembling and disassembling a backrest from a seat base, preferably for a reclining chair. Since chairs, and especially reclining chairs, are manufactured in multiple pieces, having the ability to easily, yet accurately fit check components is an important element to ensure quality standards are met, thus reducing final assembly issues or customer issues with defective products. However, prior methods of fit-checking components involved more labor intensive and time consuming processes such as bolting the seatback to the base. The mechanism disclosed herein lends itself to a simpler assembly/disassembly method comprising providing a portion of a chair, in this case a reclining chair, with the portion having at least a base 204 and mechanism 200 for securing a backrest 258 to base 204. Mechanism 200 for securing backrest 258 is as previously disclosed, and will therefore not be described any further. Backrest 258 is provided with the backrest having a plurality of back posts 260 and each of the back posts having at least two bolts 262 with bolt heads therein.

For the assembly process, backrest 258 is placed into base 204 such that bolts 262 in each of back posts 260 engage first slots 212 in coupling plate 202. Bolts 262 engage the lower slot first and then the upper slot by rotating backposts 260 into place (see FIG. 2). Backrest 258 is then secured into base 204 by rotating locking plate 214 about fastener 225 such that second slot 220 engages bolt 262 where a portion of locking plate 214 is positioned between coupling plate 202 and the head of bolt 262. In order for the engagement between locking plate 214 and bolt 262 to be secure, first portion 222 of locking plate 214 includes a region that extends towards second slot 220 that must be overcome. This creates a positive lock when engaged with bolt 262. No time consuming tightening processes are involved, nor are any loose parts used, such as nuts and bolts, that could be lost or misplaced during the assembly process.

For disassembly purposes, the process is reversed in that locking plate 214 is rotated about fastener 225 in the direction opposite to that for assembly purposes, such that second slot 220 disengages from bolt 262 and "unlocks" locking region 226. Once locking plate 214 has been disengaged, then bolts 262 are disengaged from first slots 212 by removing back posts 260. As a result, backrest 258 is then separated from base 204.

It will be appreciated by people skilled in the art that the present invention is not limited to what has been particularly shown and described above. Rather, all matter shown in the accompanying drawings or described above is to be interpreted as illustrative and not limiting. Accordingly, the scope of the present invention is defined by the appended claims rather than the foregoing description.

The invention claimed is:

1. A mechanism for coupling a seat back having a plurality of bolts extending therefrom to a base mechanism comprising:

a coupling plate having a first thickness, a first length, a first height, and a plurality of first slots and a plurality of base holes cut through said first thickness;

a locking plate having a second thickness, a hole and a second slot cut through said second thickness, wherein said hole and said second slot in said locking plate are located within a first portion of said locking plate, and wherein said locking plate further comprises a second portion generally parallel to said first portion and a connecting member oriented at an angle relative to said first portion, said connecting member thereby connecting said first portion to said second portion; and, a fastener for rotatably coupling said locking plate to said coupling plate wherein said locking plate rotates about said fastener such that a portion of said second slot in said locking plate coincides with a portion of one of said first slots in said coupling plate to form a locking region, wherein said coupling plate is fixed to said base at said base holes, said bolts engage said plurality of first slots, and said locking plate rotates about said fastener such that said second slot engages one of said bolts of said seat back in said locking region, thereby securing said seat back to said base.

2. The mechanism of claim 1, wherein said seat back has a pair of seat back posts, with bolts extending away from said seat back posts a distance D and spaced to slide into each of said first slots.

3. The mechanism of claim 2 wherein said locking plate rotates about said fastener such that said first portion of said locking plate is positioned between said coupling plate and the head of said bolt, within distance D, so as to engage one of said bolts into said locking region.

4. The mechanism of claim 3 wherein said distance D is equal to the sum of said first thickness, said second thickness, and an assembly tolerance.

5. The mechanism of claim 4 wherein said back posts further comprise a plurality of nuts fixed to each of said bolts, opposite said bolt head and adjacent said back post for securing said bolt to said back post.

6. The mechanism of claim 1 wherein said plurality of first slots comprises two slots.

7. The mechanism of claim 1 wherein said coupling plate further comprises a plurality of base holes.

8. A reclining chair assembly comprising:

a base having a reclining mechanism;

a seat mounted to said base;

a backrest having a frame and plurality of back posts, with a plurality of bolts extending a distance D from each of said back posts, said backrest capable of connecting to said base proximate said seat via said back posts;

a mechanism for securing said backrest to said base, said mechanism comprising:

a coupling plate having a first thickness, a first length, a first height, and a plurality of first slots and plurality of base holes cut through said first thickness;

a locking plate having a second thickness, a hole and a second slot cut through said second thickness, wherein said hole and said second slot in said locking plate are located within a first portion of said locking plate, and wherein said locking plate further comprises a second portion generally parallel to said first portion and a connecting member oriented at an angle relative to said first portion, said connecting member thereby connecting said first portion to said second portion; and, a fastener for coupling said locking plate to said coupling plate wherein said locking plate rotates about said fastener such that a portion of said second slot coincides with a portion of one of said first slots to form a locking region; and, wherein said coupling plate is fixed to said base at said base holes, said bolts engage said plurality of first slots, and said locking plate rotates about said fastener such that said second slot engages one of said bolts in said locking region, thereby securing said backrest to said base.

9. The reclining chair assembly of claim 8 wherein said distance D is equal to the sum of said first thickness, said second thickness, and an assembly tolerance.

10. The mechanism of claim 8 wherein said plurality of first slots comprises two slots.

11. The mechanism of claim 8 wherein said back posts further comprise a plurality of nuts fixed to each of said bolts, opposite said bolt head and adjacent said back post for securing said bolts to said back posts.

* * * * *